US007654624B2

(12) United States Patent
Huang et al.

(10) Patent No.: US 7,654,624 B2
(45) Date of Patent: Feb. 2, 2010

(54) SLIDE RAIL ASSEMBLY

(75) Inventors: Kuo-Ming Huang, Taipei Hsien (TW); Song Wang, Shenzhen (CN); Zong-Yuan Li, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 28 days.

(21) Appl. No.: 11/951,288

(22) Filed: Dec. 5, 2007

(65) Prior Publication Data

US 2009/0001864 A1 Jan. 1, 2009

(30) Foreign Application Priority Data

Jun. 27, 2007 (CN) ..... 2007 1 0200905

(51) Int. Cl.
*A47B 95/00* (2006.01)

(52) U.S. Cl. ..... 312/333; 312/334.46

(58) Field of Classification Search ..... 312/333, 312/334.44–334.47; 384/21
See application file for complete search history.

(56) References Cited

U.S. PATENT DOCUMENTS 6,749,276 B2 * 6/2004 Judge et al. ..... 312/334.47
6,979,067 B2 * 12/2005 Yang ..... 312/334.46
7,210,752 B2 * 5/2007 Dubon ..... 312/333
7,404,611 B1 * 7/2008 Que ..... 312/334.46
2004/0239221 A1 12/2004 Yang
2008/0018214 A1 * 1/2008 Huang ..... 312/334.46
2008/0124009 A1 * 5/2008 Peng et al. ..... 384/21
2008/0150409 A1 * 6/2008 Huang et al. ..... 312/334.46

FOREIGN PATENT DOCUMENTS

DE 3101594 * 1/1982
DE 3348540 * 7/1985

* cited by examiner

*Primary Examiner*—Hanh V Tran
(74) *Attorney, Agent, or Firm*—Frank R. Niranjan

(57) ABSTRACT

A slide rail assembly includes an outer slide rail having a protrusion, an intermediate slide rail having a slot, an inner slide rail having a release portion, a latch member slidably attached to a slot of the intermediate slide rail, and a resilient member connected to the latch member for returning the latch member to an original position. The latch member includes first and second engaging portions located at opposite sides of the intermediate slide rail respectively. The protrusion is capable of engaging with the second engaging portion of the latch member to stop the intermediate slide rail sliding into the outer slide rail together with the inner slide rail. The release portion of the inner slide rail is capable of engaging with the first engaging portion to bias the latch member to slide along the slot to release the intermediate slide rail from the outer engaging portion.

9 Claims, 8 Drawing Sheets

SLIDE RAIL ASSEMBLY

BACKGROUND

1. Field of the Invention

The present invention relates to a slide rail assembly.

2. Description of Related Art

Traditionally, a slide rail is used between two objects that can move relative to each other, such as between a desk and a drawer, a server and a rack etc.

A conventional slide rail assembly for a drawer and a desk includes an outer slide rail mounted to the desk, an inner slide rail mounted to the drawer, and an intermediate slide rail mounted between the outer and inner slide rails. The intermediate slide rail is extendable relative to the outer slide rail, and the inner slide rail is extendable relative to the intermediate slide rail, thus the drawer can be extended a distance out from the desk. Considerations of strength and smoothness of operation may render a given order or sequence preferable in a given slide configuration. Further, activation of external mechanisms such as cabinet interlocks may require a specific sequence of operations.

Consequently, it is required to provide a slide rail assembly having a latch mechanism urging collapsing of slide rails in a specific desired order.

SUMMARY

In one embodiment, a slide rail assembly includes an outer slide rail having a protrusion, an intermediate slide rail having a slot, an inner slide rail having a release portion, a latch member slidably attached to a slot of the intermediate slide rail, and a resilient member connected to the latch member for returning the latch member to an original position. The latch member includes a first engaging portion and a second engaging portion located at opposite ends of the intermediate slide rail respectively. The protrusion is capable of engaging with the second engaging portion of the latch member to stop the intermediate slide rail sliding into the outer slide rail together with the inner slide rail. The release portion of the inner slide rail is capable of engaging with the first engaging portion to bias the latch member to slide along the slot to release the intermediate slide rail from the outer engaging portion.

Other advantages and novel features of the present invention will become more apparent from the following detailed description of embodiment when taken in conjunction with the accompanying drawings, in which:

DETAILED DESCRIPTION

Figure 1:
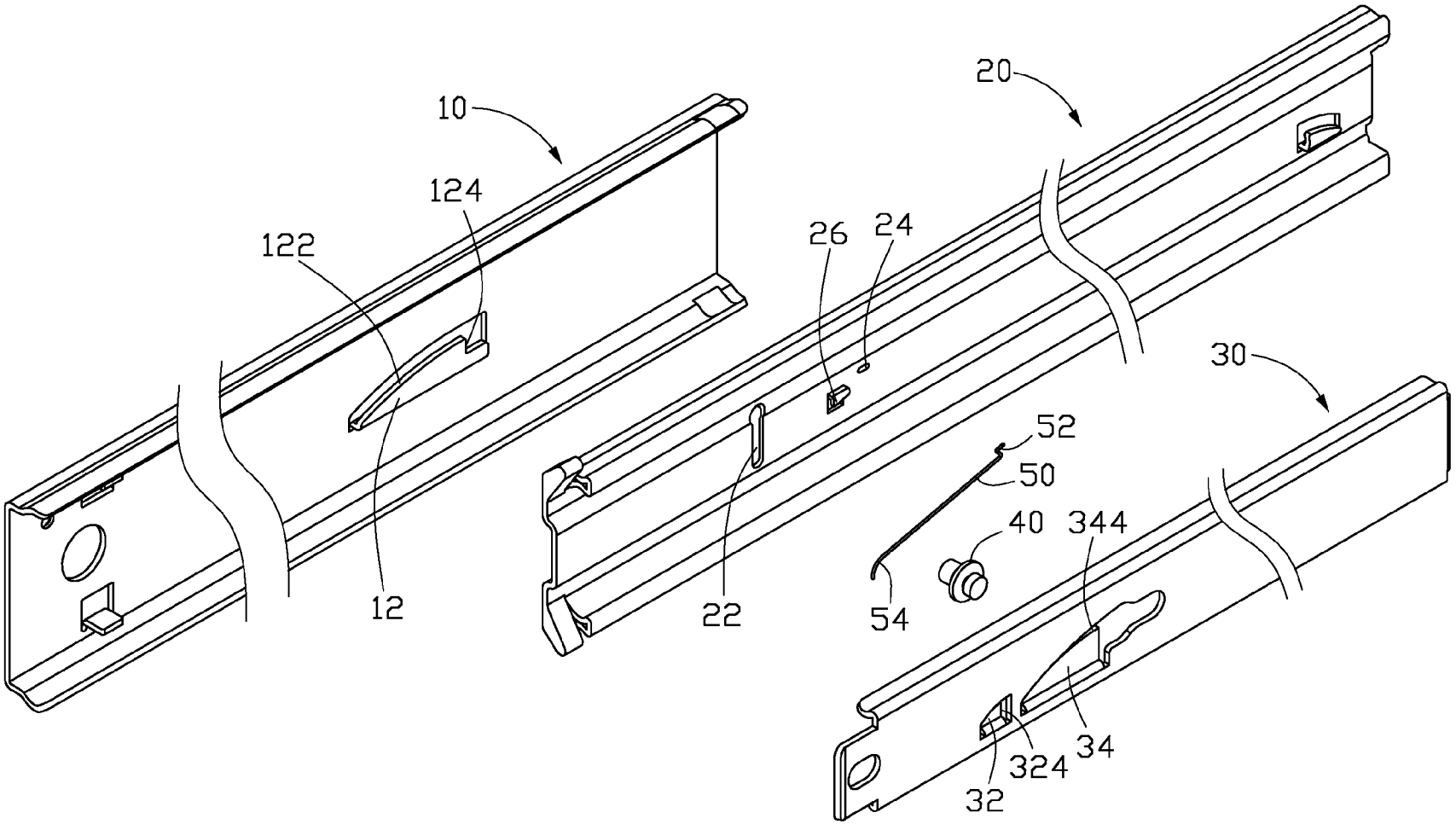
FIG. 1 is an exploded, isometric view of a slide rail assembly according to an embodiment of the present invention, the slide rail assembly including an outer slide rail, an intermediate slide rail, an inner slide rail, a latch member, and a resilient member.
Figure 2:
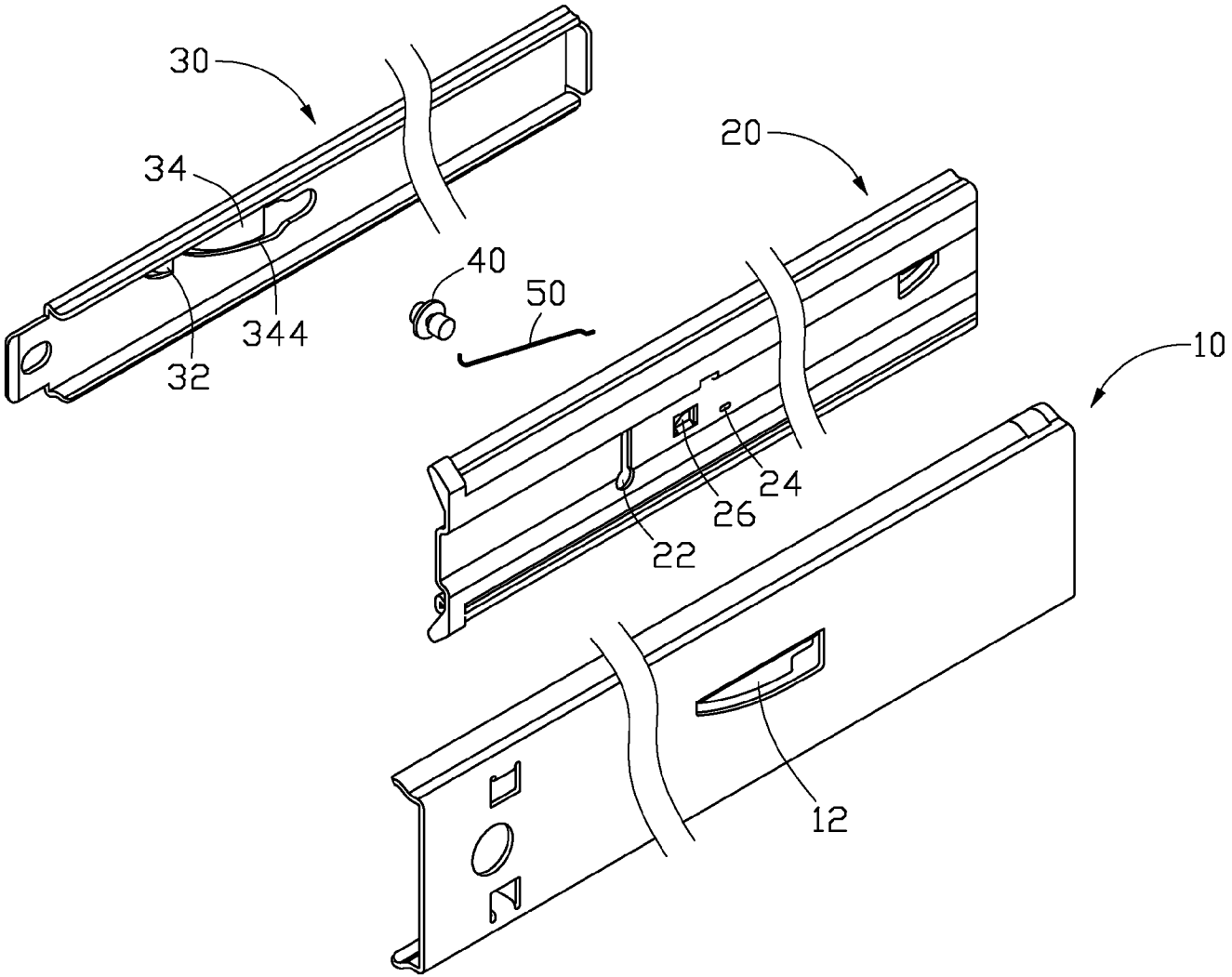
FIG. 2 is an inverted view of FIG. 1.

Referring to FIGS. 1 and 2, in an embodiment of the present invention, a slide rail assembly includes an outer slide rail 10, an intermediate slide rail 20, an inner slide rail 30, a latch member 40, and a resilient member 50.

The outer slide rail 10 includes an outer portion and two sidewalls extend from opposite sides of the outer portion. A protrusion 12 parallel to the outer portion is stamped inward from the outer portion of the outer slide rail 10. The protrusion 12 includes an inclined surface 122 at a top thereof angling up from a first end to a second end thereof, and an upright surface 124 perpendicularly extending down at the second end of the inclined surface 122.

The intermediate slide rail 20 includes an intermediate portion and two sidewalls extending from opposite sides of the intermediate portion respectively. The intermediate portion defines an upright slot 22, and a mounting hole 24 therein. An L-shaped mounting tab 26 is stamped inward from the intermediate portion between the slot 22 and the mounting hole 24. An extending direction of the slot 22 is perpendicular to a longitudinal direction of the intermediate slide rail 20. The slot 22 has a large end at the top and a small end at the bottom thereof.

The inner slide rail 30 includes an inner portion and two sidewalls extending from opposite sides of the inner portion respectively. A stop portion 32 and a release portion 34 are stamped toward the intermediate portion of the intermediate slide rail 20 from the inner portion in the vicinity of one end. The stop portion 32 is between the release portion 34 and the corresponding end of the inner portion. The stop portion 32 has a stop surface 324 at an end thereof adjacent to the release portion 34. A release surface 344 is formed on top of the release portion 34.

Figure 3:
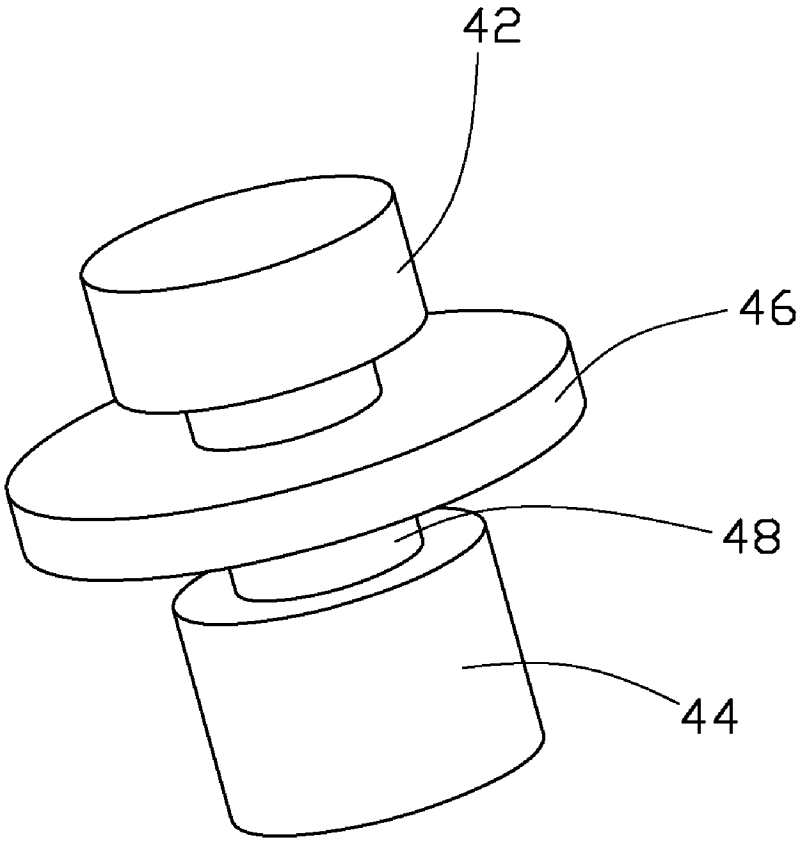
FIG. 3 is an enlarged, isometric view of the latch member of FIG. 1, but viewed from another aspect.

Referring also to FIG. 3, the latch member 40 includes a first engaging portion 42 at an end thereof, a second engaging portion 44 at an opposite end thereof, a blocking portion 46 at a middle thereof, and a neck portion 48 between the second engaging portion 44 and the blocking portion 46.

The resilient member 50 is made of a resilient metal wire. The resilient member 50 includes a mounting portion 52 and a pressing portion 54 at opposite ends thereof, respectively.

Figure 4:
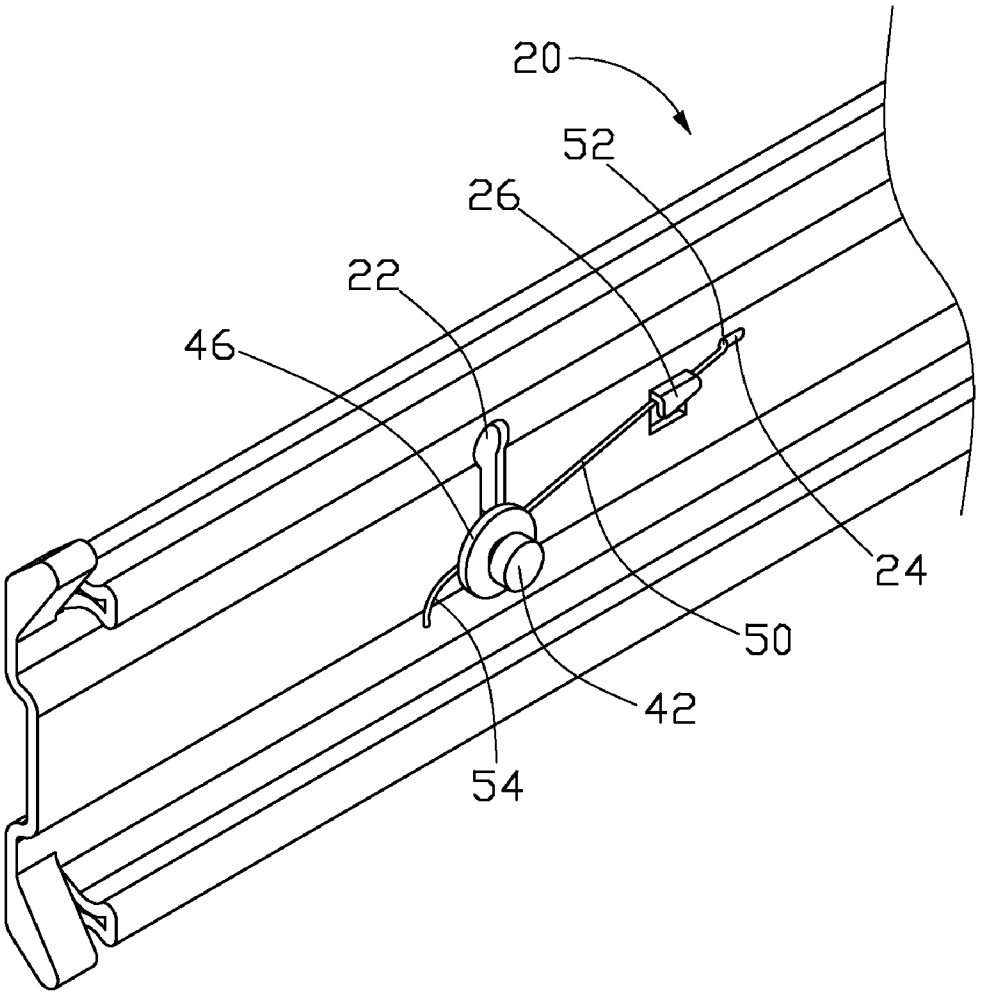
FIG. 4 is an assembled view of the intermediate slide rail, the latch member, and the resilient member of FIG. 1.

Referring also to FIG. 4, in assembly, the second engaging portion 44 of the latch member 40 is inserted through the large end of the slot 22 of the intermediate slide rail 20, and moved down, with the neck portion 48 of the latch member 40 is accommodated in the small end of the slot 22. The second engaging portion 44 is located at a side of the intermediate portion of the intermediate slide rail 20 facing the outer portion of the outer slide rail 10, and the blocking portion 46 and the first engaging portion 42 are located at an opposite side of the intermediate portion of the intermediate slide rail 20 facing the inner portion of the inner slide rail 30. The mounting portion 52 of the resilient member 50 is engaged in the mounting hole 24 of the intermediate slide rail 20. The pressing portion 54 of the resilient member 50 is resiliently loaded on the neck portion 48 of the latch member 40 between the intermediate portion of the intermediate slide rail 20 and the blocking portion 46 of the latch member 40. A middle portion of the resilient member 50 is restricted under the mounting tab 26 of the intermediate slide rail 20. The outer, intermediate, and inner slide rails 10, 20, 30 are nested in sequence to form the slide rail assembly.

Figure 5:
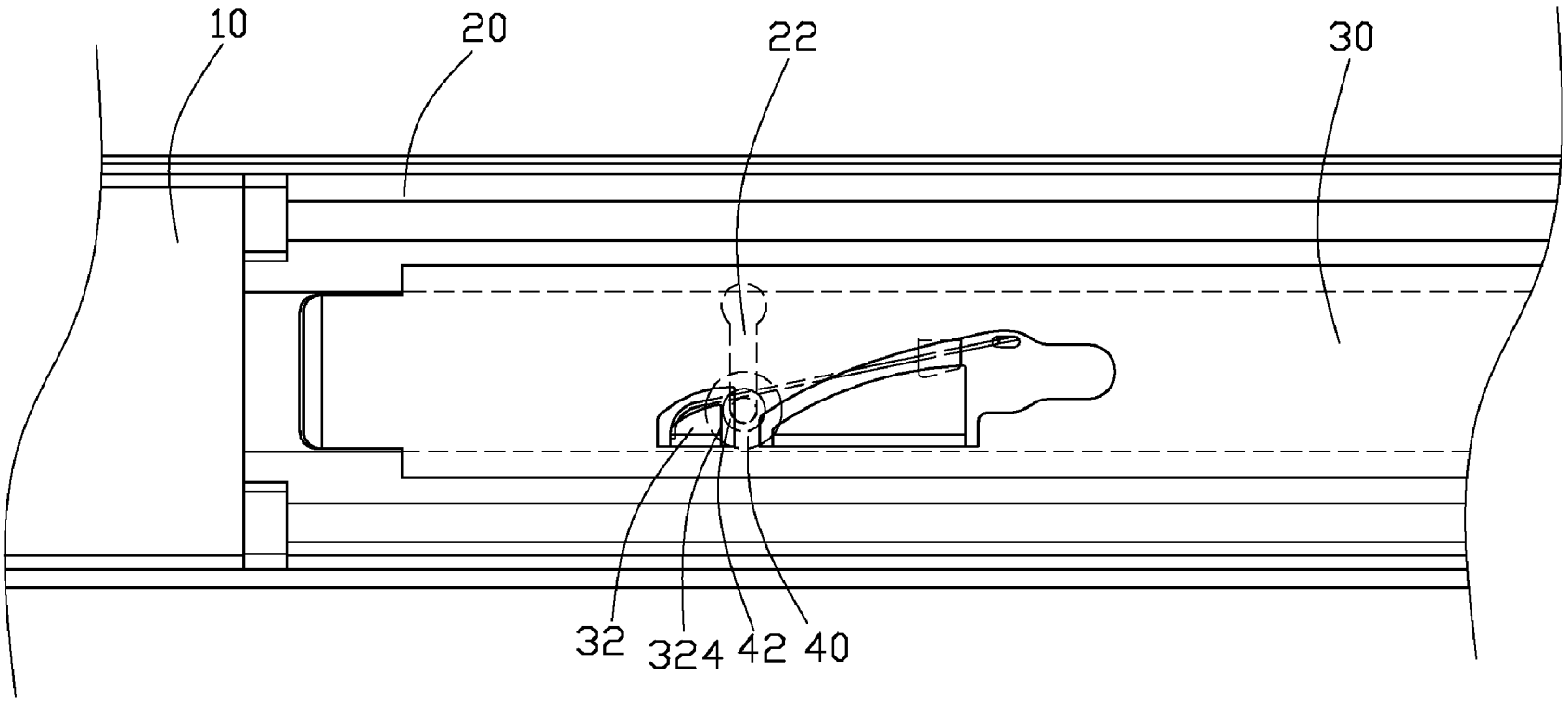
FIGS. 5-8 are assembled, lateral views of FIG. 1, showing the slide rail assembly in four states.

Referring also to FIG. 5, in extending the slide rail assembly from a superposed state, the inner slide rail 30 is pulled to slide out from the intermediate slide rail 20. When the stop portion 32 of the inner slide rail 30 moves to the latch member 40, the stop surface 324 of the stop portion 32 engages with the first engaging portion 42 of the latch member 40 to drive the intermediate slide rail 20 to extend out from the outer slide rail 10.

Figure 6:
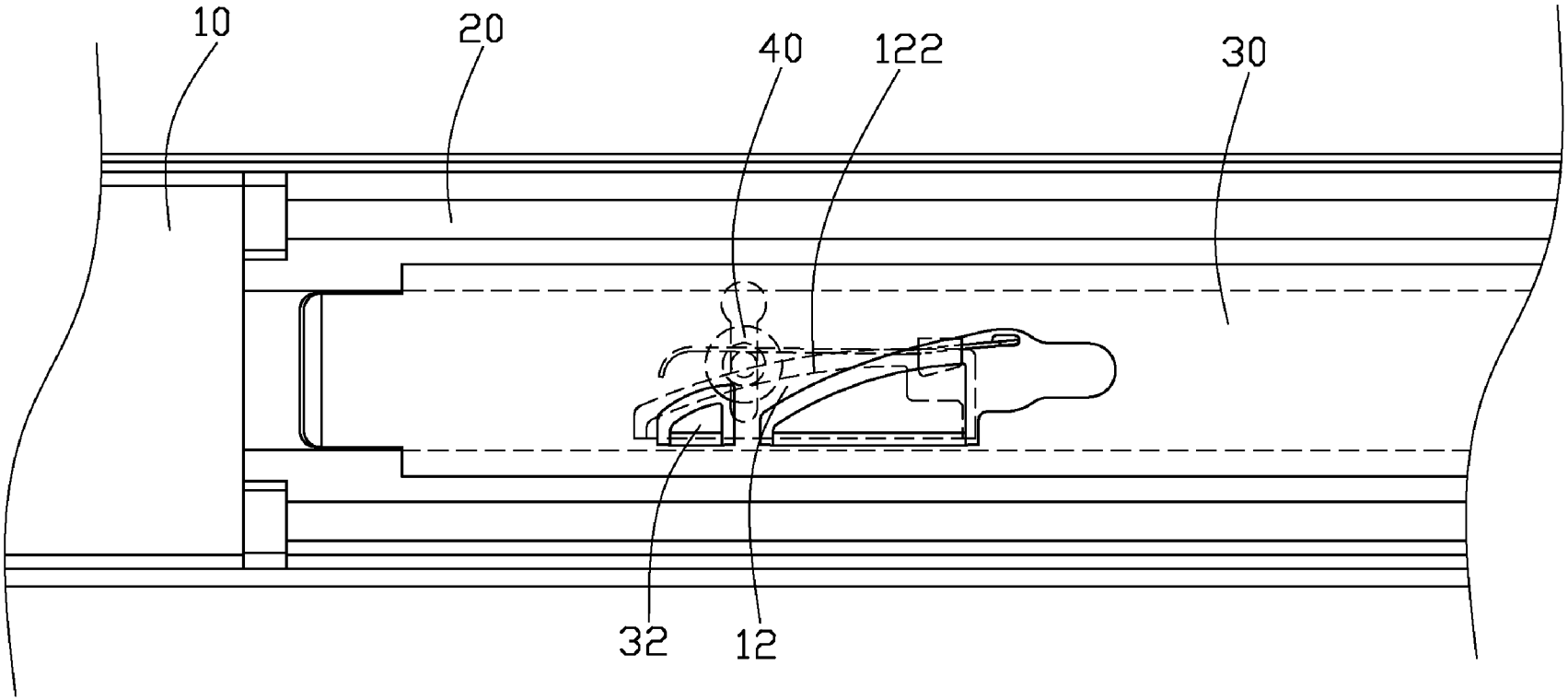
Figure 7:
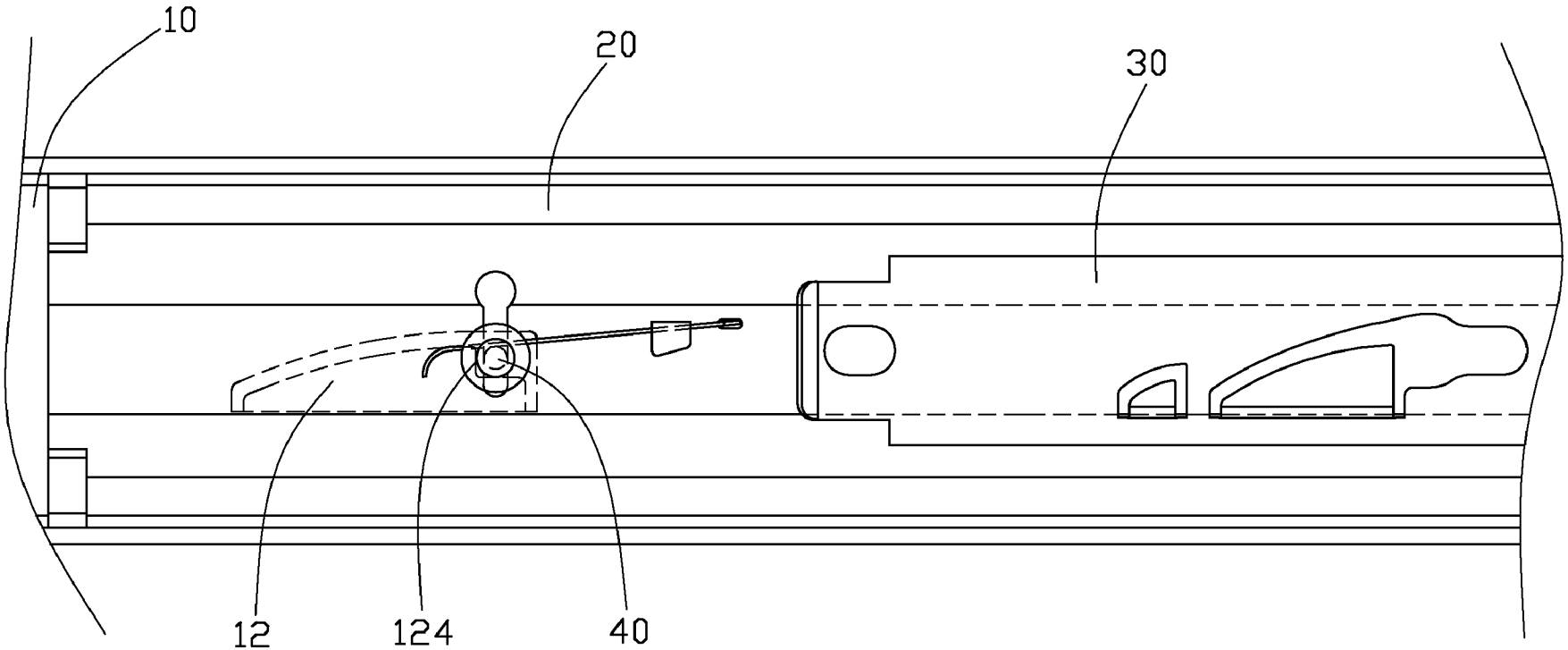

Referring also to FIGS. 6 and 7, when the latch member 40 moves to the protrusion 12 of the outer slide rail 10, the inclined surface 122 of the protrusion 12 presses the second engaging portion 44 of the latch member 40 to drive the latch member 40 to slide toward the large end of the slot 22 of the intermediate slide rail 20 against resistance of the resilient member 50, until the first engaging portion 42 of the latch member 40 is disengaged from the stop surface 324 of the stop portion 32 of the inner slide rail 30. The inner slide rail 30 continues to slide out from the intermediate slide rail 20. The second engaging portion 44 of the latch member 40 rides over the inclined surface 122 of the protrusion 12, and is placed at the upright surface 124 of the protrusion 12. The resilient member 50 is restored to drive the latch member 40 to move back to the small end of the slot 22 of the intermediate slide rail 20. Thus, the slide rail assembly is at a fully extended state.

Figure 8:
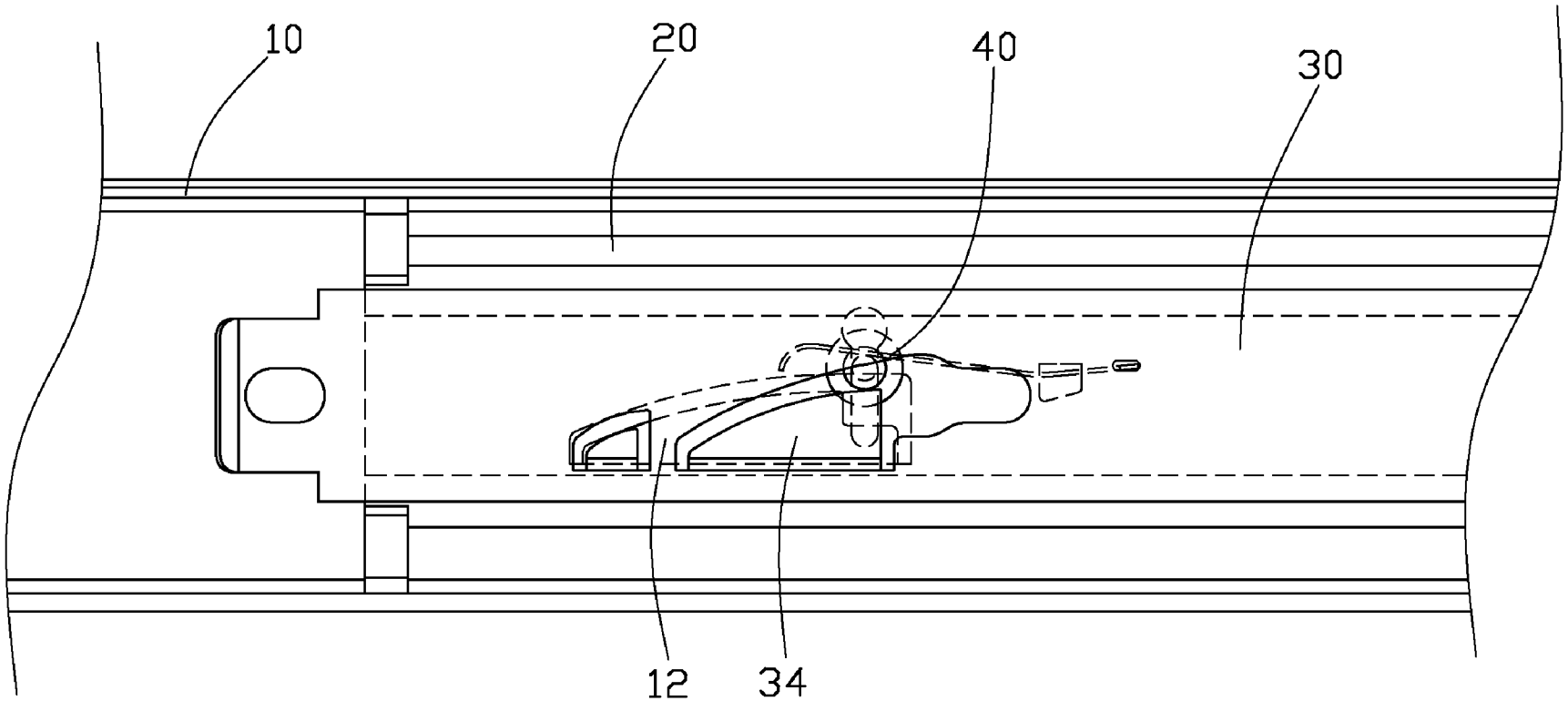

Referring also to FIG. 8, in superposing the slide rail assembly from the fully extended state, the inner slide rail 30 is pushed to slide into the intermediate slide rail 20. The second engaging portion 44 of the latch member 40 engages with the upright surface 124 of the protrusion 12 to stop the intermediate slide rail 20 sliding into the outer slide rail 10. When the release portion 34 of the inner slide rail 30 moves to the latch member 40, the release surface 344 of the release portion 34 engages with the first engaging portion 42 of the latch member 40 to drive the latch member 40 to slide toward the large end of the slot 22 of the intermediate slide rail 20, until the second engaging portion 44 of the latch member 40 is disengaged from the upright surface 124 of the protrusion 12, the intermediate slide rail 20 is driven to slide into the outer slide rail 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A slide rail assembly comprising:

an outer slide rail having a protrusion arranged thereon, the protrusion comprising an inclined surface at a top thereof angling up from a first end to a second end thereof, and an upright surface perpendicularly extending down at the second end of the inclined surface;

an intermediate slide rail slidably attached to the outer slide rail, the intermediate slide rail defining a slot therein;

an inner slide rail slidably attached to the intermediate slide rail, the inner slide rail having a release portion and a stop portion in the vicinity of one end of the inner slide rail, the stop portion comprising a stop surface at an end thereof adjacent to the release portion, the release portion comprising a release surface on top of the release portion;

a latch member attached to the intermediate slide rail and slidable along the slot of the intermediate slide rail, the latch member comprising a first engaging portion and a second engaging portion; and a resilient member connected to the latch member and the intermediate slide rail for restoring the latch member;

wherein in extending the slide rail assembly from a superposed state, the inner slide rail is pulled to slide out from the intermediate slide rail, the stop surface of the stop portion of the inner slide rail engages with the first engaging portion of the latch member to drive the intermediate slide rail to extend out from the outer slide rail;

wherein when the latch member moves to the protrusion of the outer slide rail, the inclined surface of the protrusion presses the second engaging portion of the latch member to drive the latch member to slide in the slot of the intermediate slide rail against resistance of the resilient member until the first engaging portion of the latch member is disengaged from the stop surface of the stop portion of the inner slide rail, the inner slide rail continues to slide out from the intermediate slide rail, the second engaging portion of the latch member rides over the inclined surface of the protrusion, and is placed at the upright surface of the protrusion; and wherein in superposing the slide rail assembly from a fully extended state, the inner slide rail is pushed to slide into the intermediate slide rail, the second engaging portion of the latch member engages with the upright surface of the protrusion to stop the intermediate slide rail sliding into the outer slide rail, when the release surface of the release portion engages with the first engaging portion of the latch member to drive the latch member to slide in the slot of the intermediate slide rail until the second engaging portion of the latch member is disengaged from the upright surface of the protrusion, the intermediate slide rail is driven to slide into the outer slide rail.

2. The slide rail assembly as described in claim 1, wherein the latch member further comprises a neck portion formed between the first and second engaging portions and slidably engaged with two sidewalls bounding the slot of the intermediate slide rail.

3. The slide rail assembly as described in claim 2, wherein the resilient member is made of a resilient metal wire, and comprises a mounting portion at an end thereof engaging with the intermediate slide rail, and a pressing portion formed at an opposite end thereof to be resiliently loaded on the neck portion of the latch member, the intermediate slide rail comprises a mounting tabs a middle of the resilient member is restricted under the mounting tab.

4. The slide rail assembly as described in claim 1, wherein the second engaging portion of the latch member is located at a side of the intermediate slide rail facing the outer slide rail, and the first engaging portion of the latch member is located at an opposite side of the intermediate slide rail facing the inner slide rail.

5. The slide rail assembly as described in claim 4, wherein the slot of the intermediate slide rail has a large end at an upper portion and a small end at a lower portion thereof, the latch member further comprises a neck portion between the first and second engaging portions and neighboring the second engaging portion, the neck portion is accommodated in the small end of the slot when the latch member is in the original position.

6. The slide rail assembly as described in claim 5, wherein the latch member further comprises a blocking portion at a middle thereof, the neck portion of the latch member is between the second engaging portion and the blocking portion.

7. The slide rail assembly as described in claim 6, wherein one end of the resilient member is resiliently loaded on the neck portion of the latch member between the intermediate slide rail and the blocking portion of the latch member for biasing the latch member to the small end of the slot.

8. The slide rail assembly as described in claim 1, wherein the release portion and the stop portion of the inner slide rail are each stamped toward the intermediate slide rail from the inner portion.

9. The slide rail assembly as described in claim 1, wherein the stop portion of the inner slide rail is between the release portion of the inner slide rail and the corresponding end of the inner slide rail.

* * * * *